US008820880B2

(12) United States Patent
Chandu et al.

(10) Patent No.: US 8,820,880 B2
(45) Date of Patent: Sep. 2, 2014

(54) DEFECTIVE NOZZLE DETECTION MECHANISM

(75) Inventors: Kartheek Chandu, Longmont, CO (US); Larry M. Ernst, Longmont, CO (US); Mikel J. Stanich, Longmont, CO (US); Sreenath Rao Vantaram, Rochester, NY (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 155 days.

(21) Appl. No.: 13/439,430

(22) Filed: Apr. 4, 2012

(65) Prior Publication Data

US 2013/0265360 A1 Oct. 10, 2013

(51) Int. Cl.
*B41J 29/393* (2006.01)

(52) U.S. Cl.
USPC ..... 347/19

(58) Field of Classification Search
CPC ..... B41J 2/2139; B41J 2/0451; B41J 2/165; B41J 2/16579; B41J 2/2141; B41J 2/2135; B41J 2002/165
USPC ..... 347/19
See application file for complete search history.

(56) References Cited

U.S. PATENT DOCUMENTS

| | | | | |
|---|---|---|---|---|
| 5,724,259 | A * | 3/1998 | Seymour et al. | 382/199 |
| 6,318,260 | B1 * | 11/2001 | Chu et al. | 101/365 |
| 2003/0053712 | A1 * | 3/2003 | Jansson | 382/275 |
| 2007/0223023 | A1 | 9/2007 | Yamazaki | |
| 2009/0244578 | A1 | 10/2009 | Sasayama | |
| 2010/0214347 | A1 | 8/2010 | Sasayama | |
| 2010/0220365 | A1 * | 9/2010 | Sasayama | 358/448 |
| 2010/0328383 | A1 * | 12/2010 | Yoshikawa et al. | 347/12 |
| 2011/0074862 | A1 * | 3/2011 | Sasayama | 347/19 |

* cited by examiner

*Primary Examiner* — Geoffrey Mruk
*Assistant Examiner* — Scott A Richmond
(74) *Attorney, Agent, or Firm* — Blakely, Sokoloff, Taylor & Zafman LLP

(57) ABSTRACT

A method is disclosed. The method includes receiving image data from one or more image readers and analyzing the image data to locate and classify artifacts on the medium caused by defective print engine nozzles.

12 Claims, 6 Drawing Sheets

DEFECTIVE NOZZLE DETECTION MECHANISM

FIELD OF THE INVENTION

This invention relates generally to the field of printing systems. More particularly, the invention relates to maintaining ink jet printing systems.

BACKGROUND

An ink jet printer is as an example of a printing apparatus that ejects droplets of ink onto a recording medium such as a sheet of paper for printing a specific job. Ink jet printers include one or more print engines having at least one ink jet print head provided with an ink cartridge that accommodates the ink. In operation of the print engine, ink is supplied from the ink cartridge to ejection nozzles in each print head so that a printing operation is performed by ejection of the ink droplets from selected ejection nozzles.

Present high speed ink jet printers include wide array print heads capable of printing on wider (e.g., >20 inch) mediums at high resolutions. One major issue with such ink jet print heads is the clogging of nozzles due to evaporation of solvent from ink, resulting in an increase in viscosity, an accumulation of paper dust at the nozzle surface, and an intrusion of air bubbles. Each of these results causes a failure of regular nozzle functionality and degraded print quality.

A Print Verification System (PVS) is typically used to immediately capture the printed output exiting the printer and provide feedback on any nozzle dysfunction to a controller. Most current PVSs provide an approximate estimate of the location of defective nozzles, but do not provide any information regarding the type of defect.

Accordingly, a PVS system that automatically detects, locates, classifies the type of defect and counts the number of defective nozzles is desired for facilitating efficient corrective/cleaning processes.

SUMMARY

In one embodiment, a method is disclosed. The method includes receiving image data from one or more image readers and analyzing the image data to locate and classify artifacts on the medium caused by defective print engine nozzles.

In another embodiment, a print verification system (PVS) includes one or more image readers to read image data from a print medium and a control unit to receive verification data from the image readers and analyze the verification data to locate and classify artifacts on the medium caused by defective nozzles.

In yet a further embodiment, a printer is disclosed. The printer includes a print engine having a plurality of nozzles to apply print data to a medium, a PVS to read the print data applied to the medium and a control unit to receive image data from the PVS and analyze the image data to locate and classify artifacts on the medium caused by defective nozzles.

BRIEF DESCRIPTION OF THE DRAWINGS

A better understanding of the present invention can be obtained from the following detailed description in conjunction with the following drawings, in which.

DETAILED DESCRIPTION

A print verification system is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
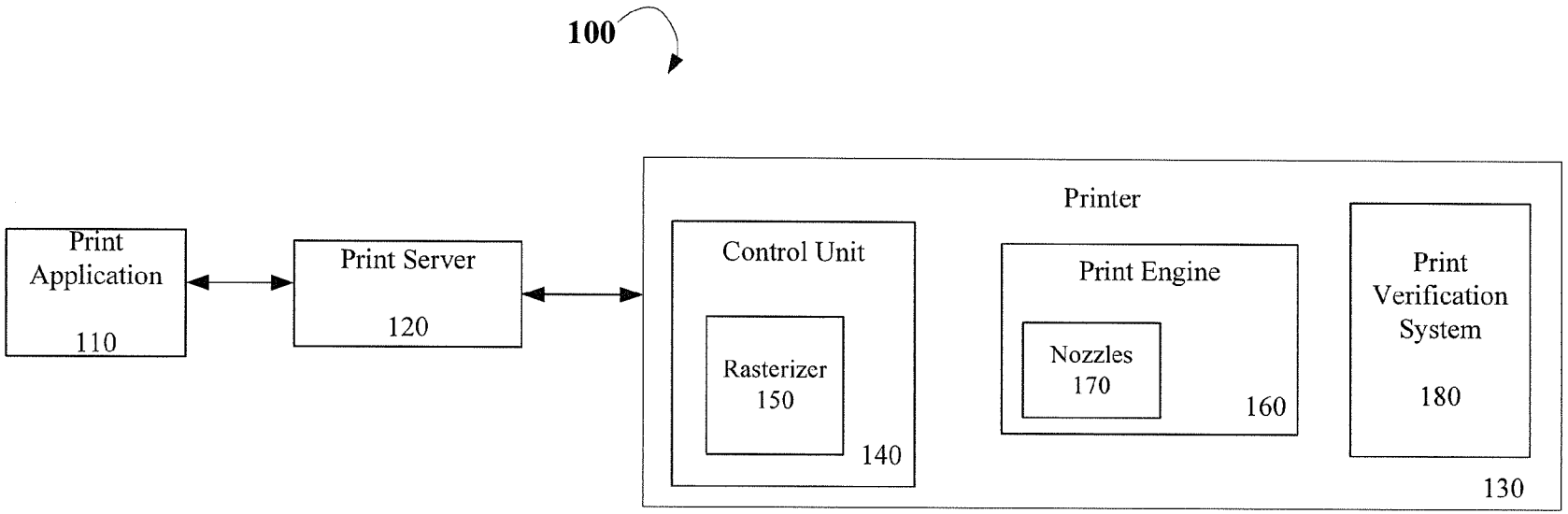
FIG. 1 illustrates one embodiment of a printing system.

FIG. 1 illustrates one embodiment of a printing system 100. Printing system 100 includes a print application 110, a print server 120 and a printer 130. Print application 110 makes a request for the printing of a document. In one embodiment, print application 110 provides a print job data stream to print server 120 in a presentation format (e.g., Advanced Function Printing, Post Script, etc.)

Print server 120 processes pages of output that mix all of the elements normally found in presentation documents (e.g., text in typographic fonts, electronic forms, graphics, image, lines, boxes, and bar codes). In one embodiment, the data stream is composed of architected, structured fields that describe each of these elements.

According to one embodiment, printer 130 includes a control unit 140, print engine 160 and print verification system (PVS) 180. In such an embodiment, print server 120 communicates with control unit 140 in order to integrate with the capabilities and command set of printer 130, and to facilitate interactive dialog between the print server 120 and printer 130. In one embodiment, the dialog between the print server 120 and printer 130 is provided according to a device-dependent bi-directional command/data stream.

Control unit 140 processes and renders objects received from print server 120 and provides sheet maps for printing to print engine 160. Control unit 140 includes a rasterizer 150 to prepare pages for printing. Particularly, rasterizer 150 includes a raster image processor (RIP) that converts text and images into a matrix of pixels (bitmap) that will be printed on a page at print engine 160.

In one embodiment, print engine 160 includes a fixed, wide-array inkjet print head having one or more nozzles 170 that are implemented to spray droplets of ink onto a sheet of paper in order to execute a print job. However, print engine 160 may include other types of ink jet print heads, as well as a moving print head design.

PVS 180 is implemented to read pages printed by print engine 160 in order for any defects on the page to be identified. In one embodiment, PVS 180 includes image line scanners that are positioned to read image data printed on each side of a medium that leaves the print engine 160. Subsequently, the image data may be forwarded to control unit 140 for analysis. Note that in other embodiments, PVS 180 may include a separate control unit to perform the analysis.

In one embodiment, control unit 140 detects printing defects on each page of a print job. In such an embodiment, control unit 140 automatically performs a procedure to mathematically classify, accurately locate and count commonly prevalent artifacts (e.g., deviated/misdirected jets and jet outs) caused by clogged nozzles across the web.

Figure 2A:
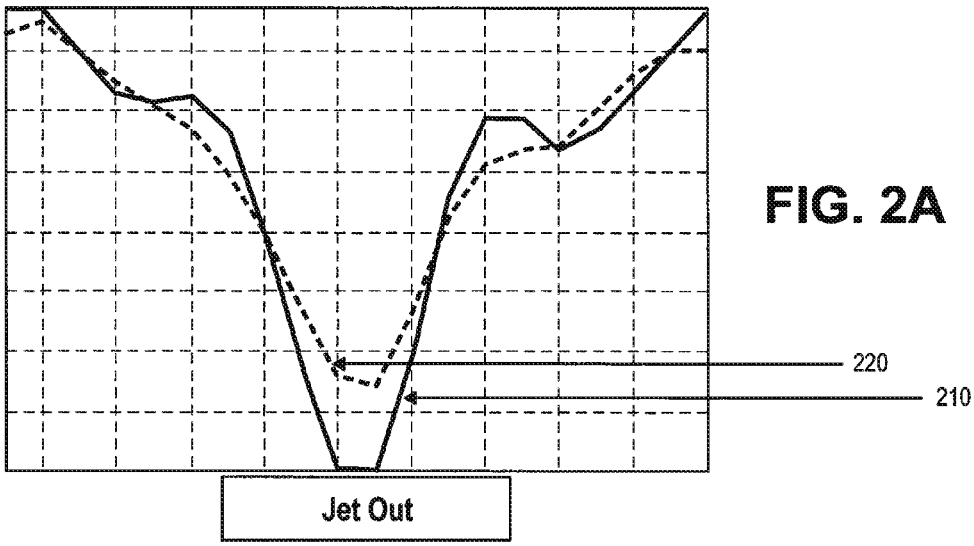
FIGS. 2A and 2B illustrate embodiments of optical density signatures.

According to one embodiment, each artifact is associated with specific optical density (OD) signatures as listed below. For example, jet out signatures have an undershoot characteristic that can be modeled by an inverted Gaussian. FIG. 2A illustrates an embodiment of OD signatures for jet out artifacts.

Figure 2B:
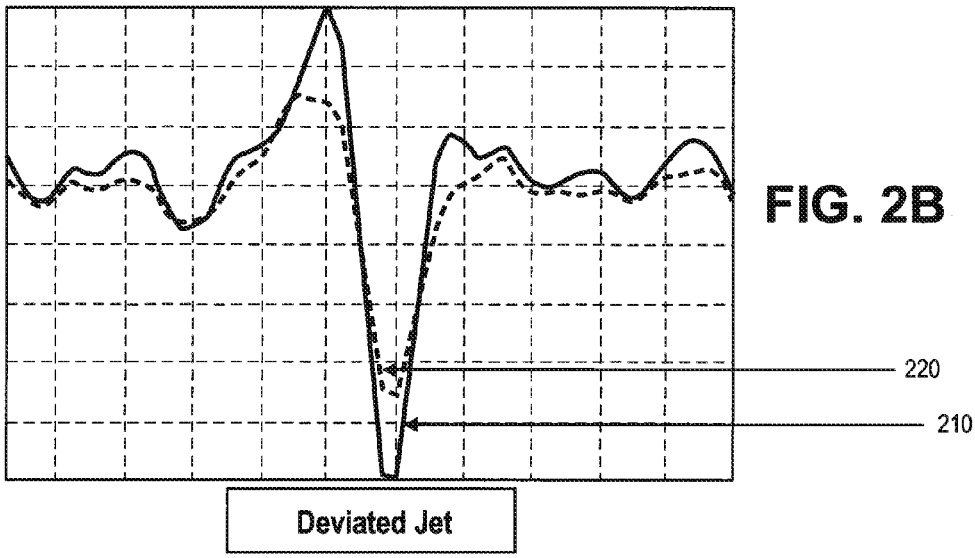

Similarly, deviated jet artifacts exhibit an overshoot and undershoot, or vice versa, signature which can be modeled by the derivatives of a single or sum of two Gaussian functions. FIG. 2B illustrates an embodiment of OD signatures for deviated jet artifacts. It should be understood that other types of reflectance measurement in any color space can also be used instead of optical density.

Figure 3:
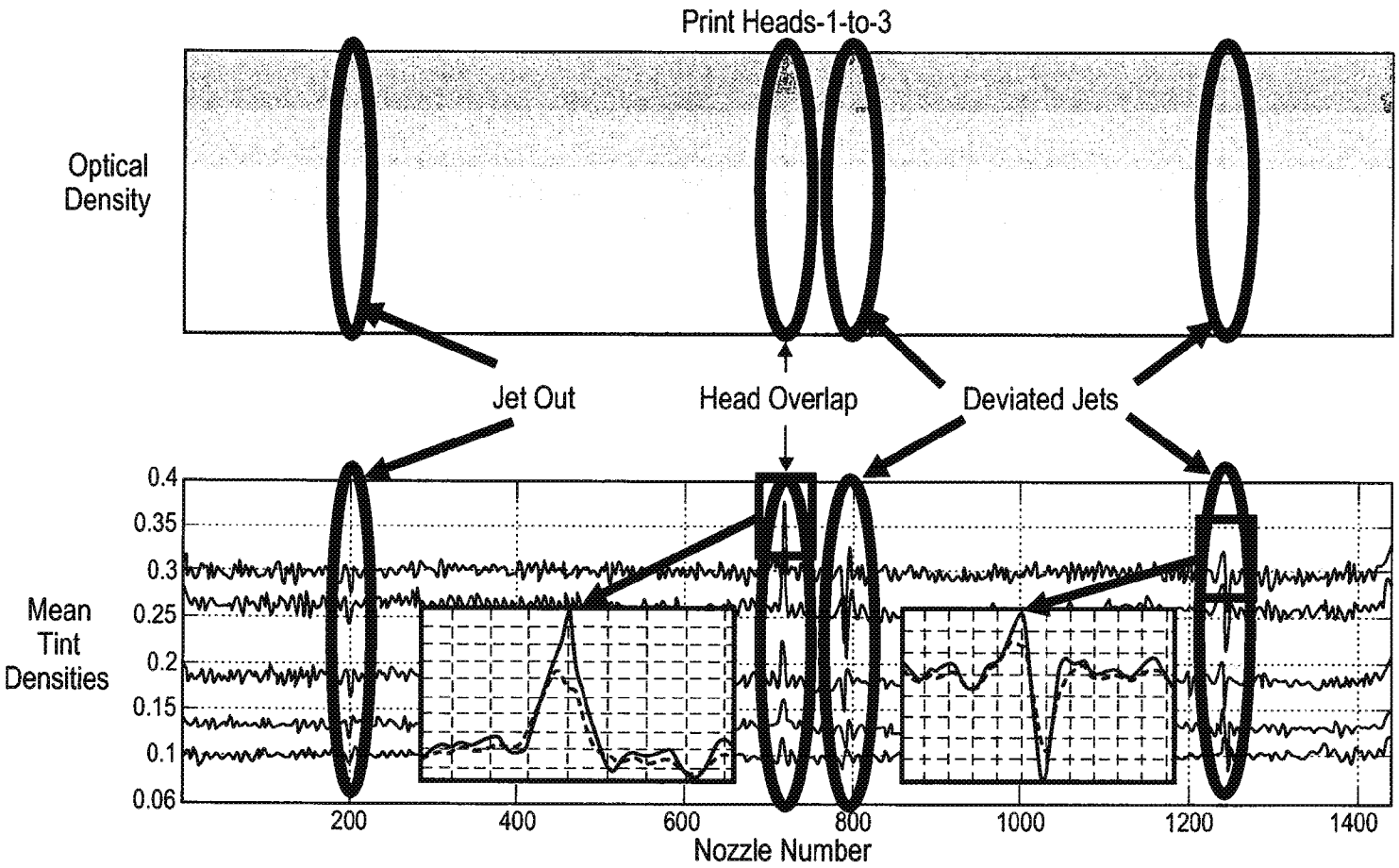
FIG. 3 illustrate one embodiment of density variations.

FIG. 3 illustrates one embodiment of mean density variations for a color target (e.g., cyan) with five tint levels. Also shown in FIG. 3 is a graph plotting the mean tint densities vs. nozzle number. As shown in FIG. 3, the mean tint density for nozzle 200 illustrates the "undershoot" characteristic attributed to jet out artifacts, while nozzles 800 and approximately 1220 exhibit the deviated jet overshoot and undershoot characteristics. Also shown, is an OD signature for a print head overlap characteristic. Print head overlap is inherent to print engine 160, although its OD signature is to be accounted for in the process for determining defective nozzles.

Figure 4:
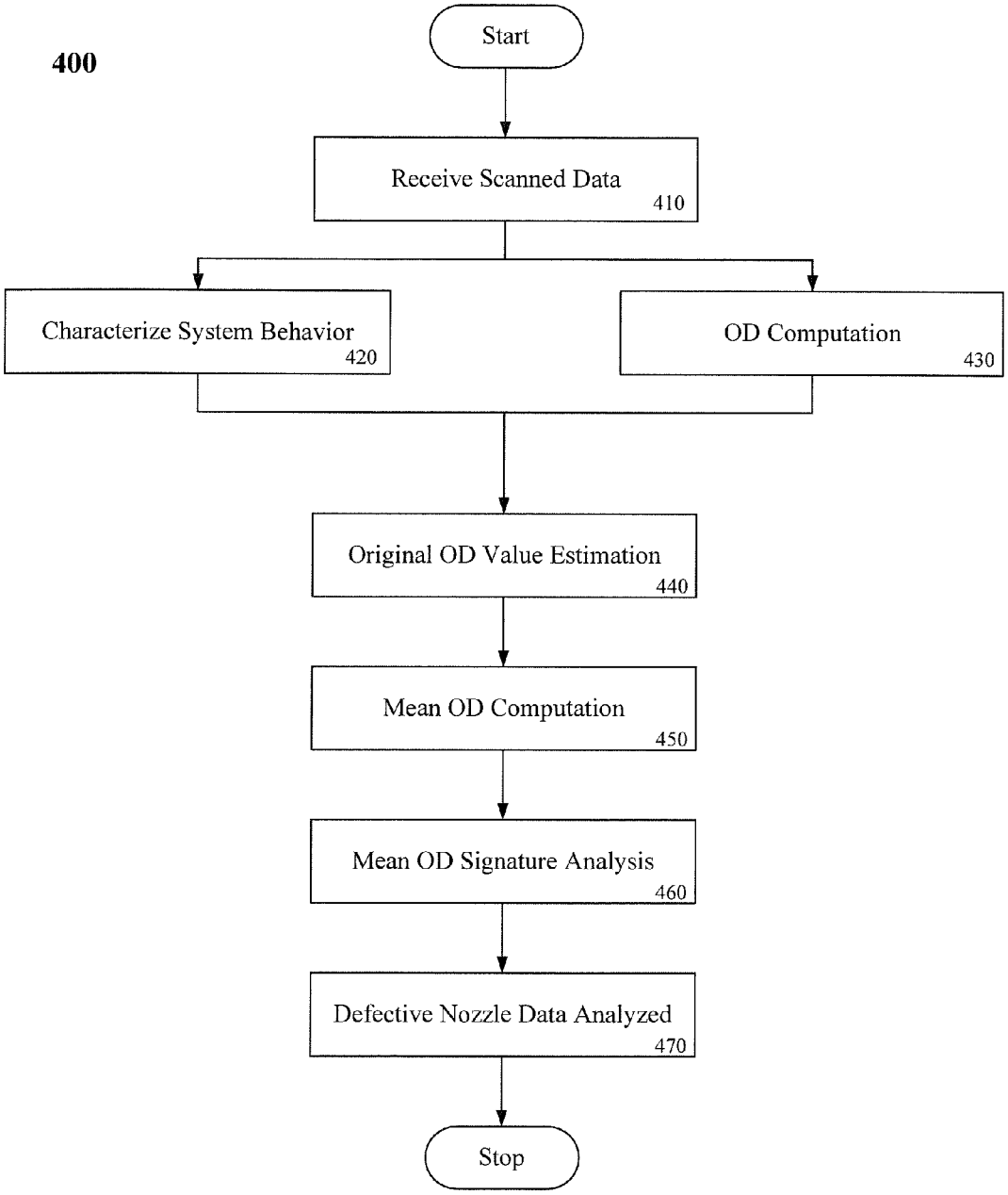
FIG. 4 is a flow diagram illustrating one embodiment of a process to determine defective nozzles.

FIG. 4 is a flow diagram illustrating one embodiment of process 400 for determining defective nozzles at print engine 160. Process 400 accurately determines (or detects) defective nozzles across an entire medium web using mean Optical Density (OD) variations per color of the input target. At processing block 410, scan data is received subsequent to a print job medium has been read at PVS 180.

At processing block 420, a characterization of system behavior is performed. Characterization of system behavior measures an amount of blurring of an image attributed to scanners (or any other optical elements) within the PVS 180. In one embodiment, system behavior is characterized by a mathematical system level characterization of the production printing system in terms of its Point Spread Function (PSF).

Figure 5:
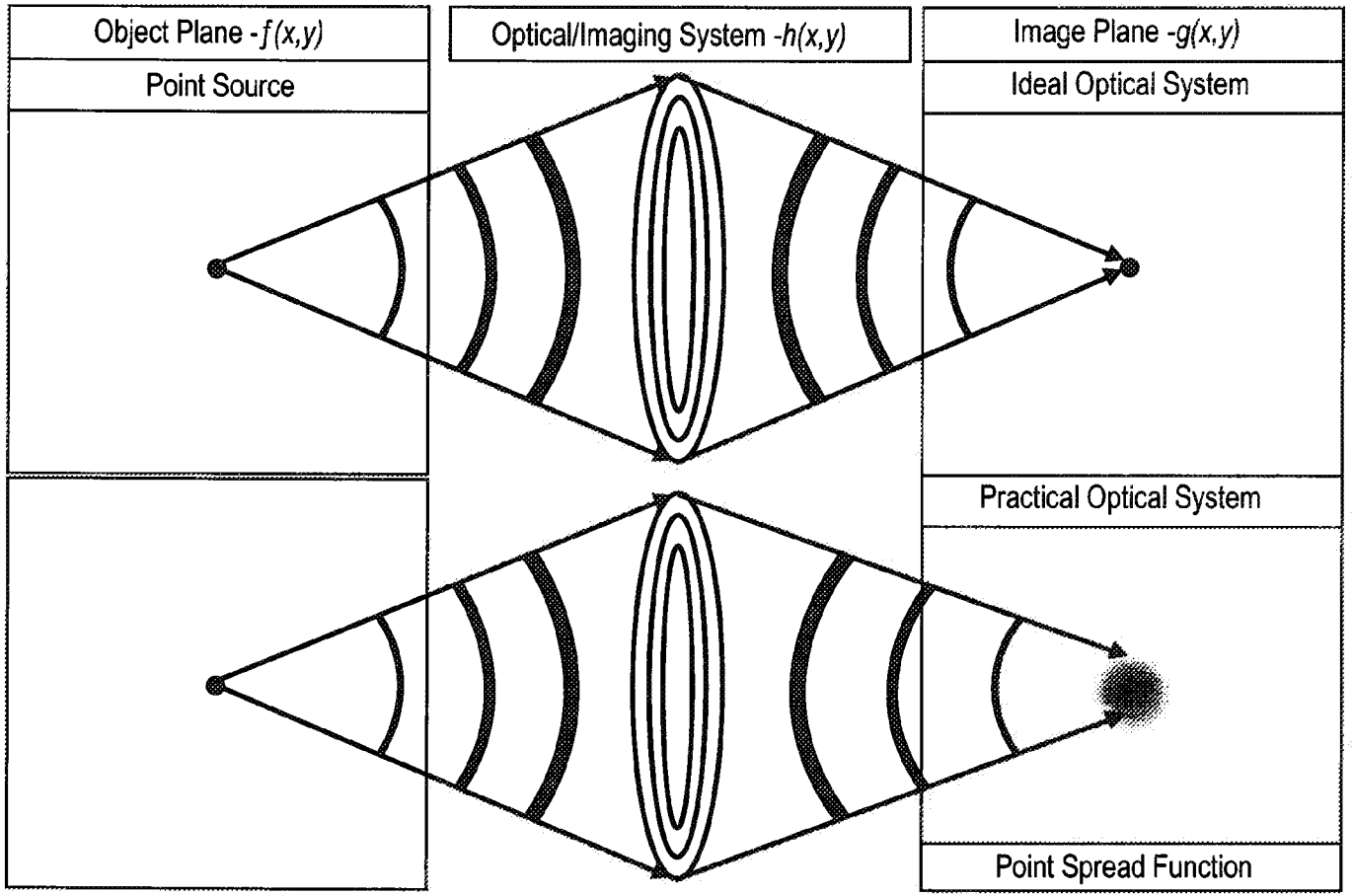
FIG. 5 illustrate one embodiment of a point spread function.

The PSF of an optical/imaging system is the image of a single point object formed at the image plane and the degree of spreading/blurring of this point at the image plane is typically used as a measure for quantifying the overall quality of an optical/imaging system. FIG. 5 illustrate one embodiment of a point spread function. As shown in FIG. 5, an object point source remains the same in an ideal optical/imaging system. However in practical optical/imaging systems, the object point source experiences significant spreading attributed to PSF.

In one embodiment, the PSF of an optical/imaging system may also be determined by computing a Line Spread Function (LSF) derived from a line target at different orientations at the object plane. The LSF at a specific orientation is the one dimensional (1-D) projection of the 2-D PSF along that orientation/direction. In a further embodiment, the PSF may be derived from a corresponding LSF obtained using single pel line targets.

Referring back to FIG. 4, having characterized the behavior of the system, next an OD computation is performed in processing block 430. In general, OD is a measure of the degree of darkness of a photographic or semitransparent material or a reflecting surface. More specifically, OD is a measure of how dark a print is relative to the paper.

In one embodiment, OD is calculated using Opponent Color Substitutions, such that:

$$X=0.4124R+0.3576G+0.1805B$$

$$Y=0.2126R+0.7152G+0.0722B$$

$$Z=0.0193R+0.1192G+0.9505B$$

$$\mathrm{OD}=+\log_{10}(100/X) \text{ for Cyan}$$

$$\mathrm{OD}=+\log_{10}(100/Y) \text{ for Magenta, Black and Paper}$$

$$\mathrm{OD}=+\log_{10}(100/Z) \text{ for Yellow}$$

In another embodiment, different color conversion mechanism can be employed which can efficiently detect variations in all colors.

At processing block 440, an estimation of original OD values is performed to simulate values at the input end of print engine 160 (e.g., to undo blurring effects). In one embodiment, the estimation is performed by de-convolution and resizing. The output g(x,y) of an imaging system can be represented as 2-D convolution of the input f(x,y) with the PSF h(x,y) (e.g., g(x,y)=f(x,y)*h(x,y)). Typically, most 'real-world' imaging/optical systems (including the Human Visual System-HVS) have an effect of "blurring" the input f(x,y) at the image plane (or the retina of the eye).

De-convolution is a procedure employed as a solution to the inverse problem of estimating the original input at the object plane, f(x,y) given the effect (or PSF) of the optical/imaging system h(x,y) and the output at the image plane g(x,y). From a mathematical view point de-convolution is represented as:

$$\hat{f}(x, y) = g(x, y) * \frac{1}{h(x, y)}$$

or $$\hat{F}(\xi, \eta) = \left\{\frac{G(\xi, \eta)}{H(\xi, \eta)}\right\} \Rightarrow \hat{f}(x, y) = \mathfrak{F}^{-1}\{\hat{F}(\xi, \eta)\}$$

Blind De-convolution is a de-convolution technique that permits recovery of the input from a single or set of "blurred" output images in the presence of a poorly determined/unknown PSF. Following the de-convolution procedure the data under every print head is resized to match physical nozzle alignment.

De-convolution facilitates a mechanism to counteract the effect of the printing system on the data being printed, renders the de-convolved data to be close representations of the effective original/input data values to the printing system. Additionally, de-convolution substantially increases the fidelity and sensitivity of the OD values, enabling accurate capture of defective nozzles and classification of the artifact type without the blurring introduced by the printer and scanner.

At processing block 450, mean OD is computed using OD information. At processing block 460, a signature analysis of the mean OD is performed. As discussed above with reference to FIGS. 2 and 3, signature analysis is performed by monitoring for undershoot and overshoot characteristics at each nozzle 170. For example in FIGS. 2A and 2B, lines 210 represent the signatures after de-convolution (without blurring effects), while lines 220 represent the signatures with blurring effects.

At processing block 470, the defective nozzle data is analyzed. For instance, a determination is made of the location and total number of defective nozzles 170, as well as each artifact type.

Figure 6:
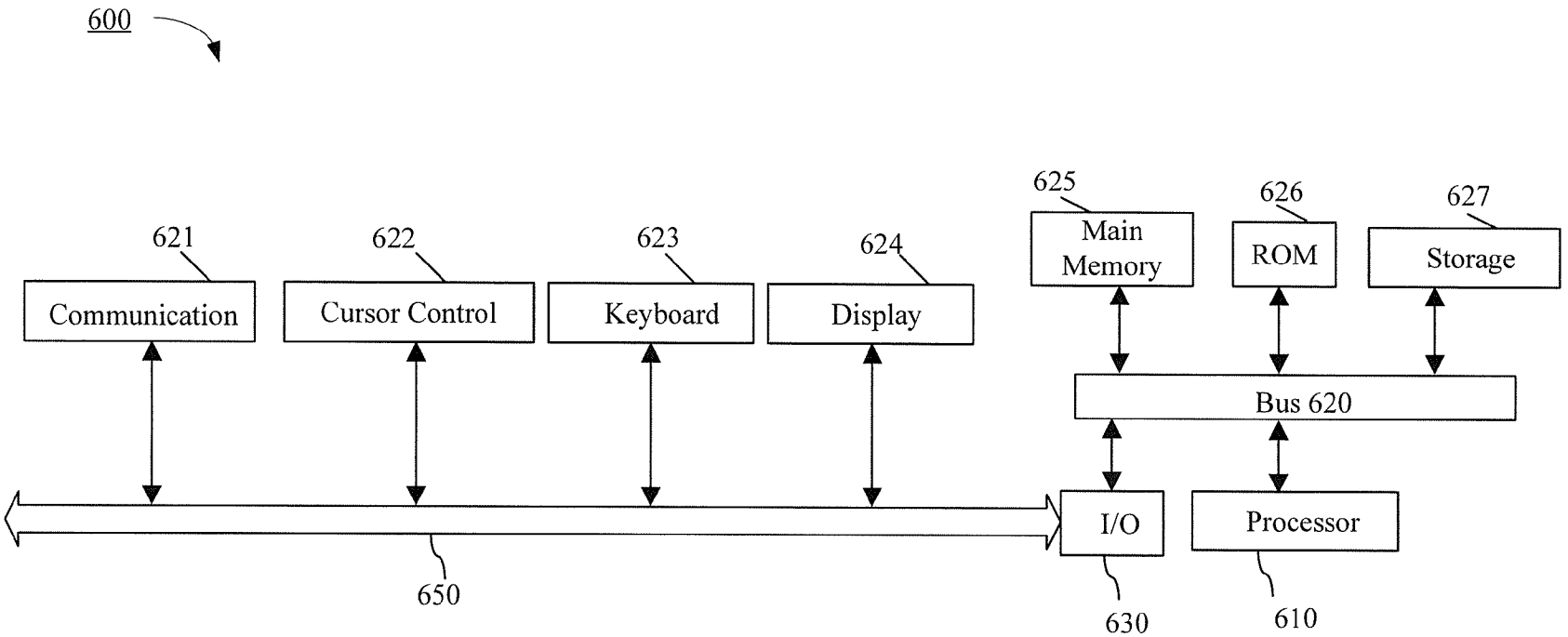
FIG. 6 illustrates one embodiment of a computer system.

FIG. 6 illustrates a computer system 600 on which print controller 140 and/or print server 120 may be implemented. Computer system 600 includes a system bus 620 for communicating information, and a processor 610 coupled to bus 620 for processing information.

Computer system 600 further comprises a random access memory (RAM) or other dynamic storage device 625 (referred to herein as main memory), coupled to bus 620 for storing information and instructions to be executed by processor 610. Main memory 625 also may be used for storing temporary variables or other intermediate information during execution of instructions by processor 610. Computer system 600 also may include a read only memory (ROM) and or other static storage device 626 coupled to bus 620 for storing static information and instructions used by processor 610.

A data storage device 625 such as a magnetic disk or optical disc and its corresponding drive may also be coupled to computer system 600 for storing information and instructions. Computer system 600 can also be coupled to a second I/O bus 650 via an I/O interface 630. A plurality of I/O devices may be coupled to I/O bus 650, including a display device 624, an input device (e.g., an alphanumeric input device 623 and or a cursor control device 622). The communication device 621 is for accessing other computers (servers or clients). The communication device 621 may comprise a modem, a network interface card, or other well-known interface device, such as those used for coupling to Ethernet, token ring, or other types of networks.

Embodiments of the invention may include various steps as set forth above. The steps may be embodied in machine-executable instructions. The instructions can be used to cause a general-purpose or special-purpose processor to perform certain steps. Alternatively, these steps may be performed by specific hardware components that contain hardwired logic for performing the steps, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Throughout the foregoing description, for the purposes of explanation, numerous specific details were set forth in order to provide a thorough understanding of the invention. It will be apparent, however, to one skilled in the art that the invention may be practiced without some of these specific details. Accordingly, the scope and spirit of the invention should be judged in terms of the claims which follow.

What is claimed is:

1. A printer comprising:

a print engine having a plurality of nozzles to apply print data to a medium;

a print verification system (PVS) to read the print data applied to the medium; and a control unit to receive image data from the PVS and analyze the image data to locate artifacts on the medium caused by defective nozzles and to classify a first artifact associated with a first optical density (OD) signature as a first defect type and a second artifact associated with a second OD signature as a second defect type, wherein the first OD signature includes an undershoot characteristic and the second OD signature includes an undershoot characteristic.

2. The printer of claim 1 wherein analyzing the image data comprises:

performing a characterization of system behavior;

performing an OD computation;

performing an estimation of original OD values to simulate values at the input end of the print engine;

computing a mean OD;

performing a signature analysis of the mean OD;

analyzing defective nozzle data.

3. The printer of claim 2 wherein characterization of system behavior measures an amount of blurring of an image attributed to the PVS.

4. The printer of claim 3 wherein system behavior is characterized by a mathematical system level characterization in terms of a Point Spread Function (PSF) for the printer.

5. The printer of claim 2 wherein performing the estimation of original OD values comprises performing de-convolution and resizing.

6. The printer of claim 2 wherein computing the mean OD comprises performing a signature analysis.

7. The printer of claim 6 wherein the signature analysis is performed by monitoring characteristics at each of the plurality of nozzles.

8. The printer of claim 7 wherein each artifact is associated with an OD signature.

9. The printer of claim 1 wherein the control unit counts a total number of detected artifacts.

10. A print verification system (PVS) comprising:

one or more image readers to read image data from a print medium; and a control unit to receive image data from the PVS and analyze the image data to locate artifacts on the medium caused by defective nozzles and to classify a first artifact associated with a first optical density (OD) signature as a first defect type and a second artifact associated with a second OD signature as a second defect type, wherein the first OD signature includes an undershoot characteristic and the second OD signature includes an undershoot characteristic.

11. The PVS of claim 10 wherein analyzing the image data comprises:

performing a characterization of system behavior;

performing an OD computation;

performing an estimation of original OD values to simulate values at the input end of the print engine;

computing a mean OD;

performing a signature analysis of the mean OD;

analyzing defective nozzle data.

12. The PVS of claim 10 wherein the control unit counts a total number of detected artifacts.

* * * * *